US007197115B2

(12) United States Patent
Unger et al.

(10) Patent No.: US 7,197,115 B2
(45) Date of Patent: Mar. 27, 2007

(54) CANTILEVER AND STRADDLE X-RAY TUBE CONFIGURATIONS FOR A ROTATING ANODE WITH VACUUM TRANSITION CHAMBERS

(75) Inventors: Christopher D. Unger, Brookfield, WI (US); Darren L. Hallman, Clifton Park, NY (US); Walter Smith, Ballston Spa, NY (US); James E. Simpson, Niskayuna, NY (US)

(73) Assignee: General Electric Company, Schnectady, NY (US)

( * ) Notice: Subject to any disclaimer, the term of this patent is extended or adjusted under 35 U.S.C. 154(b) by 150 days.

(21) Appl. No.: 10/710,877

(22) Filed: Aug. 10, 2004

(65) Prior Publication Data

US 2006/0034425 A1 Feb. 16, 2006

(51) Int. Cl.
*H01J 35/20* (2006.01)

(52) U.S. Cl. ..... 378/123; 378/125; 378/130; 378/132; 378/144

(58) Field of Classification Search ..... 378/119, 378/121–144
See application file for complete search history.

(56) References Cited

U.S. PATENT DOCUMENTS 4,577,340 A * 3/1986 Carlson et al. ..... 378/132
5,799,951 A * 9/1998 Anderson et al. ..... 277/301
5,978,447 A * 11/1999 Carlson et al. ..... 378/132
6,212,256 B1 * 4/2001 Miesbauer et al. ..... 378/118
6,496,564 B2 * 12/2002 Price et al. ..... 378/130

* cited by examiner

*Primary Examiner*—Edward J. Glick
*Assistant Examiner*—Jurie Yun
(74) *Attorney, Agent, or Firm*—Peter J. Vogel

(57) ABSTRACT

An imaging tube assembly (11) for a computed tomography (CT) system (10) includes an insert (60) that has a vacuum chamber (72). An anode (58) resides within the vacuum chamber (72) and rotates on a shaft (66) via one or more bearing (70). In one embodiment, a seal (52) resides between the insert (60) and the shaft (66). The seal (52) prevents the passage of a gas (80) into the vacuum chamber (72). In another embodiment, a pressure transition chamber (104) is coupled to an insert (60") and a shaft (66"). The pressure transition chamber (104) has an associated middle fluid pressure that is between an internal fluid pressure of the vacuum chamber (104) and an external fluid pressure of said insert (60").

39 Claims, 6 Drawing Sheets

CANTILEVER AND STRADDLE X-RAY TUBE CONFIGURATIONS FOR A ROTATING ANODE WITH VACUUM TRANSITION CHAMBERS

BACKGROUND OF INVENTION

The present invention relates generally to computed tomography (CT) imaging systems. More particularly, the present invention relates to a system for sealing and cooling a rotating anode and associated vacuum vessel.

A CT imaging system typically includes a gantry that rotates at various speeds in order to create a 360° image. The gantry contains an x-ray source, such as an x-ray tube that generates x-rays by bombardment of an anode by a high energy electron beam from a cathode physically separated from the anode by a vacuum gap. The anode has a target that is coupled to a shaft, which rotates on a pair of anode bearings. X-rays are emitted from the target and are projected in the form of a fan-shaped beam, which is collimated to lie within an X-Y plane of a Cartesian coordinate system, generally referred to as the "imaging plane". The x-ray beam passes through the object being imaged, such as a patient. The beam, after being attenuated by the object, impinges upon an array of radiation detectors. Each detector element of the array produces a separate electrical signal that is a measurement of the beam attenuation at the detector location. The attenuation measurements from all the detectors are acquired separately to produce a transmission profile for the generation of an image.

It is desirable to increase gantry rotating speeds and x-ray tube peak operating power such that faster imaging times and improved image quality can be provided. With increased gantry rotational speed comes increased load on the x-ray tube bearing. Although the use of bearing grease may allow for increased load on the bearing, since the bearing is inside the high voltage vacuum of the x-ray tube, grease or oil lubricated bearings cannot be utilized. Outgassing from the grease or oil leads to the degradation of the high voltage vacuum. This degradation causes high voltage instability and improper operation of the x-ray tube and can render the x-ray tube inoperable. Also, the use of silver or lead as a lubrication on the bearings is no longer able to sustain the required loads for adequate x-ray tube life.

Current tubes have an insert enclosed within a casing. The interior of the insert is under a high vacuum. An oil bath resides between the insert and the casing. The oil bath is utilized to cool the insert. Thermal energy radiates from a rotating anode within the insert, through the insert, and into the oil bath. The heated oil is cooled by circulation thereof through a heat exchanger. Thermal energy in the oil is transferred in the heat exchanger to ambient air, or, alternatively, a coolant, which circulates to and from an external chiller. This method of cooling the rotating anode in and of itself is also inadequate for increased gantry rotating speeds.

One design that currently exists for improved bearing performance and increased bearing life as well as improved cooling includes the use of a rotating insert, often referred to as a "rotating frame tube". The rotating insert resides on a shaft that rotates on a set of fluid lubricated journal bearings or ball bearings. The ball bearings are cooled by an oil bath surrounding the insert. A rotating anode is located within and is formed or coupled as part of the insert. The rotating anode is directly cooled via a coolant circulating within the anode. Although the design provides increased bearing performance and operating life and direct cooling of a rotating anode, the design has several associated disadvantages.

The rotating frame tube design is limited in peak power and requires a large motor for rotation of the insert, which increases heat generation into a gantry and limits the x-ray tube thermal performance. The design also has a long electron beam path between the cathode and the target of the anode. The use of this long beam path can result in focal spot irregularities. These irregularities include a highly non-uniform intensity or unstable focus of the x-ray beam. The irregularities increase with an increase in target size and negatively affect image clarity and usefulness.

Thus, there exists a need for an improved x-ray tube having improved bearing performance and operating life and improved thermal performance without the above-stated disadvantages.

SUMMARY OF INVENTION

The present invention provides an imaging tube assembly for a diagnostic imaging system. The imaging tube assembly includes an insert that has a vacuum chamber. An anode resides within the vacuum chamber and rotates on a shaft via one or more bearings. In one embodiment, a seal resides between the insert and the shaft. The seal prevents the passage of atmospheric gasses into the vacuum chamber. In another embodiment, a pressure transition chamber encases a portion of the seal and is coupled to the insert and the shaft. The pressure transition chamber has a middle pressure approximately in between an internal vacuum level pressure present in the vacuum chamber and atmospheric pressure.

The embodiments of the present invention provide several advantages. One such advantage is the provision of a rotating anode internal to a stationary insert. Non-rotation of the insert allows for the usage of a motor with less output power. Lower output power allows for usage of a smaller and less costly motor that produces a smaller amount of heat. Usage of a smaller motor increases the available space within a CT system.

Another advantage provided by an embodiment of the present invention is the provision of providing a rotating anode with minimal space between the anode and the cathode. The reduced anode/cathode spacing allows for improved focal spot control, which tends to provide smaller and better shaped focal spots. Improved focal spot size and shape provides improved image quality and visualization of small anatomy.

Yet another advantage provided by an embodiment of the present invention, is the provision of directly cooling an insert with a coolant, such as water or glycol. This simplifies the CT system and eliminates the need for an oil bath and other related components. The elimination of an oil bath aids in satisfying environmental, health, and safety concerns normally attributed with an x-ray system.

Still yet another advantage provided by an embodiment of the present invention, is the provision of using pressure transition chambers. The pressure transition chambers ease the transition in pressure between the vacuum chamber of an x-ray tube and external or room air, which increases the operating life of the x-ray tube and related components.

Furthermore, the above-described advantages separately and in combination provide improved x-ray tube performance, reliability, and allow for decreased x-ray tube design cycle times.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
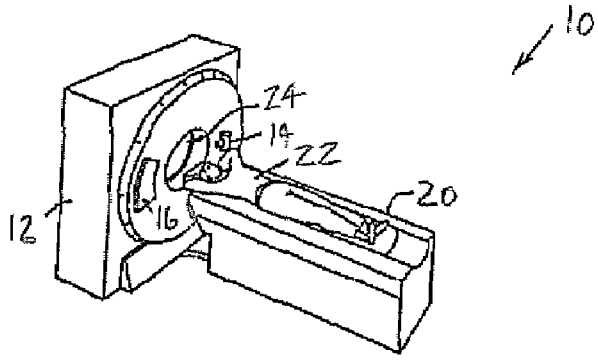
FIG. 1 is a perspective view of a CT imaging system incorporating an x-ray tube assembly in accordance with an embodiment of the present invention.

In the following Figures the same reference numerals will be used to refer to the same components. While the present invention is described with respect to a system for sealing and cooling a rotating anode and associated vacuum vessel, the present invention may be adapted and applied to various systems including computed tomography (CT) systems, x-ray systems, Mammography systems, Vascular systems, Surgical-C systems, Radiographic (RAD) systems, RAD and Fluoroscopy Systems, and mixed modalities, such as CT-positron emission tomography (PET) or CT-Nuclear.

In the following description, various operating parameters and components are described for one constructed embodiment. These specific parameters and components are included as examples and are not meant to be limiting.

Figure 2:
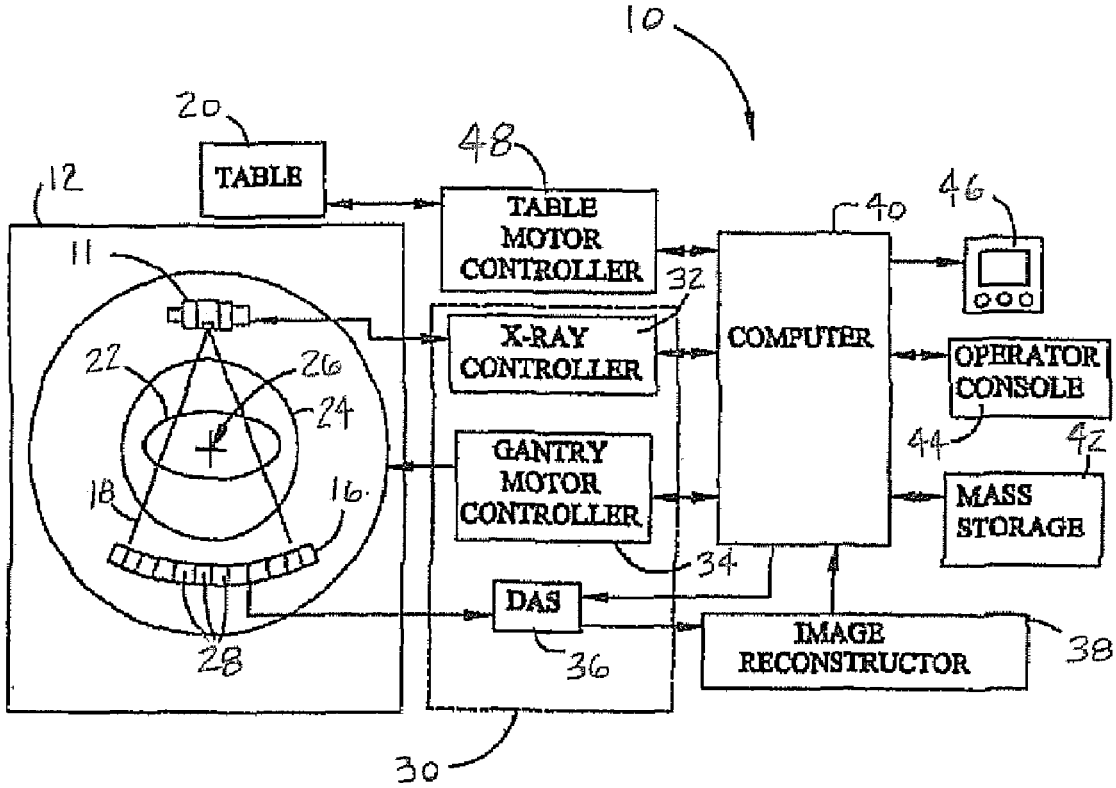
FIG. 2 is a schematic block diagrammatic view of the CT imaging system in accordance with an embodiment of the present invention.

Referring now to FIGS. 1 and 2, perspective and schematic block diagrammatic views of a CT imaging system 10 incorporating an x-ray source or x-ray tube assembly 11 are shown in accordance with an embodiment of the present invention. The imaging system 10 includes a gantry 12 that has the x-ray tube assembly 11, and a detector array 16. The tube assembly 11 projects a beam of x-rays 18 towards the detector array 16. The tube assembly 11 and the detector array 16 rotate about an operably translatable table 20. The table 20 is translated along a z-axis between the tube assembly 11 and the detector array 16 to perform a helical scan. The beam 18 after passing through the medical patient 22, within the patient bore 24, is detected at the detector array 16. The detector array 16 upon receiving the beam 18 generates projection data that is used to create a CT image.

The x-ray tube assembly 11 and the detector array 16 rotate about a center axis 26. The beam 18 is received by multiple detector elements 28. Each detector element 28 generates an electrical signal that corresponds to the intensity of the impinging x-ray beam 18. As the beam 18 passes through the patient 22 the beam 18 is attenuated. Rotation of the gantry 12 and the operation of x-ray tube assembly 11 are governed by a control mechanism 30. The control mechanism 30 includes an x-ray controller 32 that provides power and timing signals to the x-ray tube assembly 11 and a gantry motor controller 34 that controls the rotational speed and position of the gantry 12. A data acquisition system (DAS) 36 samples the analog data, generated from the detector elements 28, and converts the analog data into digital signals for the subsequent processing thereof. An image reconstructor 38 receives the sampled and digitized x-ray data from the DAS 36 and performs high-speed image reconstruction to generate the CT image. A main controller or computer 40 stores the CT image in a mass storage device 42.

The computer 40 also receives commands and scanning parameters from an operator via an operator console 44. A display 46 allows the operator to observe the reconstructed image and other data from the computer 40. The operator supplied commands and parameters are used by the computer 40 in operation of the control mechanism 30. In addition, the computer 40 operates a table motor controller 48, which translates the table 20 to position the patient 22 in the gantry 12.

Figure 3:
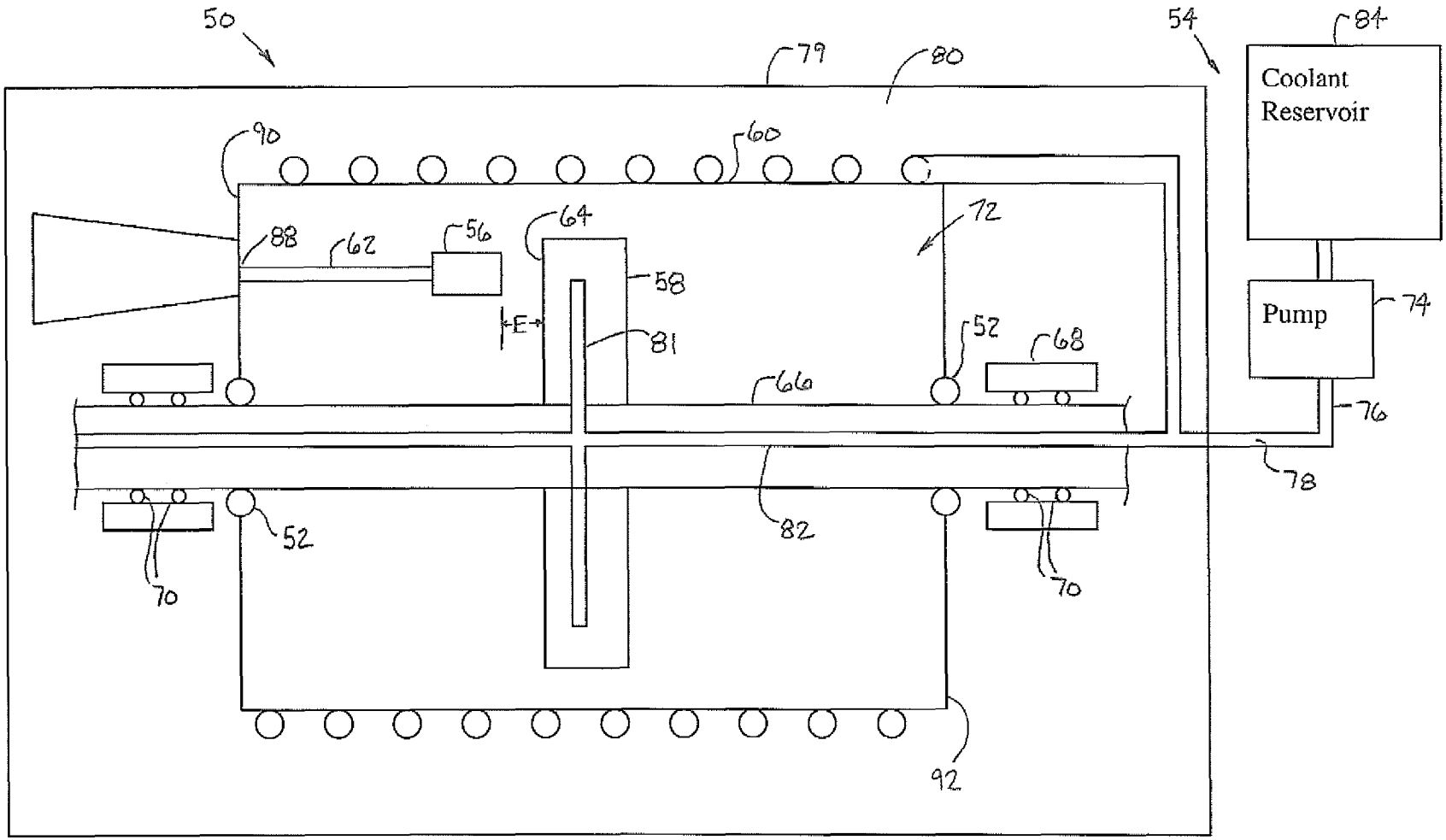
FIG. 3 is a cross-sectional block diagrammatic and schematic view of an x-ray tube assembly in a straddle configuration and incorporating rotating vacuum seals a direct anode cooling system in accordance with an embodiment of the present invention.

Referring now to FIG. 3, a cross-sectional block diagrammatic and schematic view of an x-ray tube assembly 50 in a straddle configuration and incorporating rotating vacuum seals 52 and a direct anode cooling system 54 in accordance with an embodiment of the present invention is shown. The x-ray tube assembly 50 includes a suspended cathode 56 and a rotating anode 58 that reside within an insert 60. The cathode 56 is suspended within the insert 60 on a cathode-suspending member 62. The cathode-suspending member 62 allows the cathode 56 to be positioned in close proximity with a target 64 of the anode 58 providing a short electron path E therebetween. The anode 58 is rigidly coupled on a shaft 66 that rotates on bearing sets 68 having bearing 70. The insert 60 is stationary. The anode 58 rotates relative to the insert 60. The shaft 66 is sealed with respect to the insert 60 via the rotating vacuum seals 52 that reside between the shaft 66 and the insert 60. The rotating vacuum seals 52 allow the shaft 66 to rotate relative to the insert 60 while preventing gasses 80, such as those that exist in atmospheric air and/or those that can evolve from grease of the bearings 70 from passing into the vacuum chamber 72 of the insert 60. A pump 74 is coupled via coolant lines 76 to the shaft 66 and circulates coolant 78 through the shaft 66 and the anode 58 for direct cooling thereof. The insert 60 resides within a casing 79 and is surrounded by the gases 80.

The anode 58 contains one or more cooling fluid channels 81, which receive and allow passage of the cooling fluid 78 to and from the anode 58. The channels 81 are coupled to the cooling fluid lines 76 via the shaft channels 82.

The insert 60 may be surrounded by coolant channel coil 83, which may be coupled to the pump 74 and the coolant reservoir 84 via the cooling lines 76. The coolant channel coil 83 wraps around and resides on the insert 60. Of course, other various configurations of the coolant channel coil 83 or the like may be envisioned by one skilled in the art.

The bearing sets 68 are external to the insert 60. The bearing sets 68 may be sealed from the cooling fluid 78 or may allow the cooling fluid 78 to pass through the bearings sets 68 for additional cooling thereof. The bearing sets may be coupled to and form a single unit with the seals 52 or may be separate from the seals 52 as shown. The bearing sets 68 may be of various types and styles. The bearings 70 may be greased or oil lubricated since they reside external to the insert 60 and may reside on a first external side 90 and a second external side 92 as shown. External mounting of the bearing sets 68 relative to the insert 60 allows for easier servicing of the bearing sets 68 and prevents oil leakage or outgassing therefrom into the vacuum chamber 72. Any number of bearing sets may be utilized.

The rotating vacuum seals 52 provide a vacuum seal between the vacuum chamber 72 and gasses at atmospheric pressure, such as gases 80. The rotating vacuum seals 52 allow rotation of the shaft 66 relative to the insert 60 and prevents leakage of the cooling fluid 78 into the vacuum chamber 72. The rotating vacuum seals 52 may be in the form of a ferro-fluidic seal containing ferro-fluidic materials, such as those produced by Ferrotec Corporation or Rigaku Corporation. The seals 52 may also be in the form of Gallium fluid seals or other seals known in the art. In one embodiment of the present invention, the rotating vacuum seals 52 contain a ferrofluidic oil with iron particles. The rotating vacuum seals 52 may also be of various types and styles.

The pump 74 may pump cooling fluid 78 directly into the shaft 66, as shown. The pump 74 is coupled to a coolant reservoir 84, which may contain water, glycol, oil, or other cooling fluid known in the art. In one embodiment of the present invention, the cooling fluid 78 is directly circulated from the reservoir 84 and through the casing 79. The direct cooling of the casing 79 with a coolant, such as water or glycol instead of oil, eliminates the need for a heat exchanger and accompanying fluid circuitry and provides increased cooling efficiency of the x-ray tube assembly 50. The coolant reservoir 84 may be in the form of a chiller or may be coupled to a chiller for cooling of the cooling fluid 78. When oil is utilized a heat exchanger (not shown) may reside and be fluidically coupled between the casing and the pump or reservoir. The heat exchanger transfers thermal energy in the oil to the coolant circulating between the heat exchanger and the reservoir.

Figure 4:
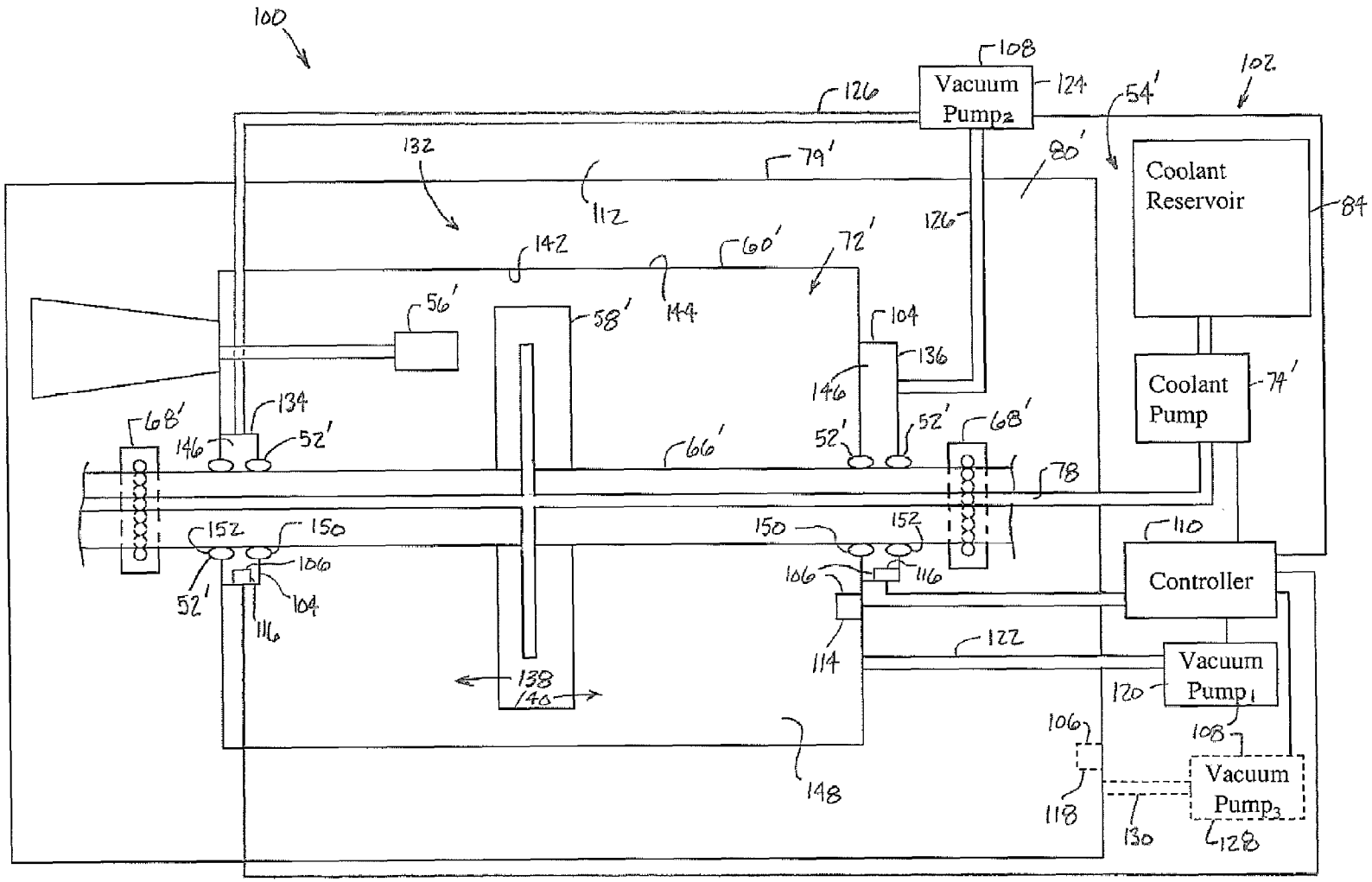
FIG. 4 is a cross-sectional block diagrammatic and schematic view of an x-ray tube assembly in a straddle configuration and incorporating a vacuum pressure transition system in accordance with another embodiment of the present invention.

Referring now to FIG. 4, a cross-sectional block diagrammatic and schematic view of an x-ray tube assembly 100 in a straddle configuration and incorporating a vacuum pressure transition system 102 in accordance with an embodiment of the present invention is shown. The x-ray tube assembly 100 is similar to the x-ray tube assembly 50 and includes a suspended cathode 56" and rotating anode 58" residing within an insert 60". The rotating anode 58" is coupled onto a rotating shaft 66". The rotating shaft 66" rotates on a pair of bearing sets 68". The shaft 66" is sealed relative to the insert 60" via rotating vacuum seals 52". The transition system 102 is coupled to the insert 60" and the shaft 66" and allows for a transitional or double "step down" in vacuum pressure rather than a large single step down. The term "step down", in general, refers to a transition in pressure from a first area to a second area adjacent the first area. This double step down provides an intermediary step down in vacuum pressure, which prevents leakage of gas inside the casing 80" through the rotating vacuum seals 52". Of course, additional step downs in vacuum pressure may be provided as will become evident in view of the following description.

The transition system 102 includes one or more middle vacuum chambers 104, vacuum sensors 106, vacuum pumps 108, and a controller 110. Vacuum pressures within the insert 60", middle chambers 104, and the casing 79" are monitored and adjusted such that a double step down in vacuum pressure exists between the vacuum chamber 72" and gasses 80" or the outer fluid 112 that is external to the casing 79". The outer fluid 112 may for example be room air. A first vacuum sensor 114 is coupled to the controller 110 and resides within the vacuum chamber 72". The first vacuum sensor 114 detects a first vacuum pressure or internal fluid pressure within the vacuum chamber 72". One or more middle vacuum sensors 116 are coupled to the controller 110 and reside within the middle chambers 104. The middle vacuum sensors 116 detect vacuum pressures within the middle chambers 104, respectively. A second vacuum sensor 118 may be used and may also be coupled to the controller 110 and reside within the casing 79". The third sensor 118 detects vacuum pressure within the gas 80". The third sensor 118 may be used as a middle chamber vacuum sensor, as further described below.

A first pump 120 is coupled to the insert 60" via first fluid lines 122 and pumps fluid, such as air, out of the insert 60" to generate a vacuum therein. A second pump 124 is coupled to the middle chambers 104, via a second fluid line 126, and similarly pumps fluid, such as air out of the middle chambers 104. A third pump 128 may be coupled to the casing 79" via a third fluid line 130 and used to pump fluid, such as air, out of the casing 79". The second pump 124 and the third pump 128 may be small in size and have a low amount of output power relative to the first pump 120, since the vacuum pressures desired within the middle chambers 104 and possibly in the cooling fluid bath 80" are significantly higher or under a significantly lower vacuum than that in the vacuum chamber 72".

The double step down transition includes a first step down transition between the vacuum pressures within the insert 60" and the middle chambers 104. A second step down transition exists between the vacuum pressures within the middle chambers 104 and the internal casing area 132 between the insert 60" and the casing 79". A third step down may exist between the vacuum pressures within the internal casing area 132 and the outer area 112.

The middle chambers 104 may be referred to as pressure transition chambers and may be configured to be inside the insert 60" as is a first middle chamber 134 or outside the insert 60" as is a second middle chamber 136. The first middle chamber 134 is coupled to the shaft 66" on the cathode side 138 of the anode 58". The second middle chamber 136 is coupled to the shaft 66" on the noncathode side 140 of the anode 58". In the present example embodiment, the middle chambers 104 are coupled onto an internal side 142 and an external side 144 of the insert 60", as shown. The middle chambers 104 may be of various types, styles, shapes, and sizes.

In other sample embodiments, the casing 79" performs as a middle chamber or pressure transition chamber and the middle chambers 104 may or may not be utilized. When the casing 79" is utilized as a pressure transition chamber a double step down transition may include a first step down transition between the vacuum pressures within the insert 60" and the internal casing area 132, which in this stated embodiment may be considered a middle chamber. A second step down transition may exist between the vacuum pressures within the internal casing area or middle chamber 132 and the outer area 112. The middle chambers 104 may be utilized to provide additional step down transitions in vacuum pressure between the vacuum chamber 72" and the outer fluid 112.

The vacuum pressure of the middle fluid 146 within the middle chambers 104 is less, or in other words under a higher vacuum, than the vacuum pressure of an external fluid or fluid external to the middle chambers 104 and the insert 60", such as fluid in the internal casing area 132 and the outer fluid 112. The vacuum pressure of the middle fluid 146 is greater, or in other words under a lower vacuum, than an internal fluid 148 residing within the vacuum chamber 72".

Each middle chamber 104 has an internal set of rotating vacuum seals 150 and an external set of rotating vacuum seals 152. The internal set of seals 150 provides a sealed barrier between the vacuum chamber 72" and the middle chambers 104. The external set of seals 152 provides a sealed barrier between the middle chambers 104 and the internal casing area 132, or when the internal casing area 132 is utilized as a middle chamber, between the middle chambers 104 and the outer area 112.

The controller 110 may not only control the operation of the vacuum pumps 108, but may also control operation of the coolant pump 74". The controller 110 may be microprocessor based such as a computer having a central processing unit, have memory (RAM and/or ROM), and have associated input and output buses. The controller 110 may be in the form of an application-specific integrated circuit or may be formed of other logic devices known in the art. The controller 110 may be a portion of a central or main control unit. The controller 110 may be combined into a single controller or may be a stand-alone controller as shown.

Figure 5:
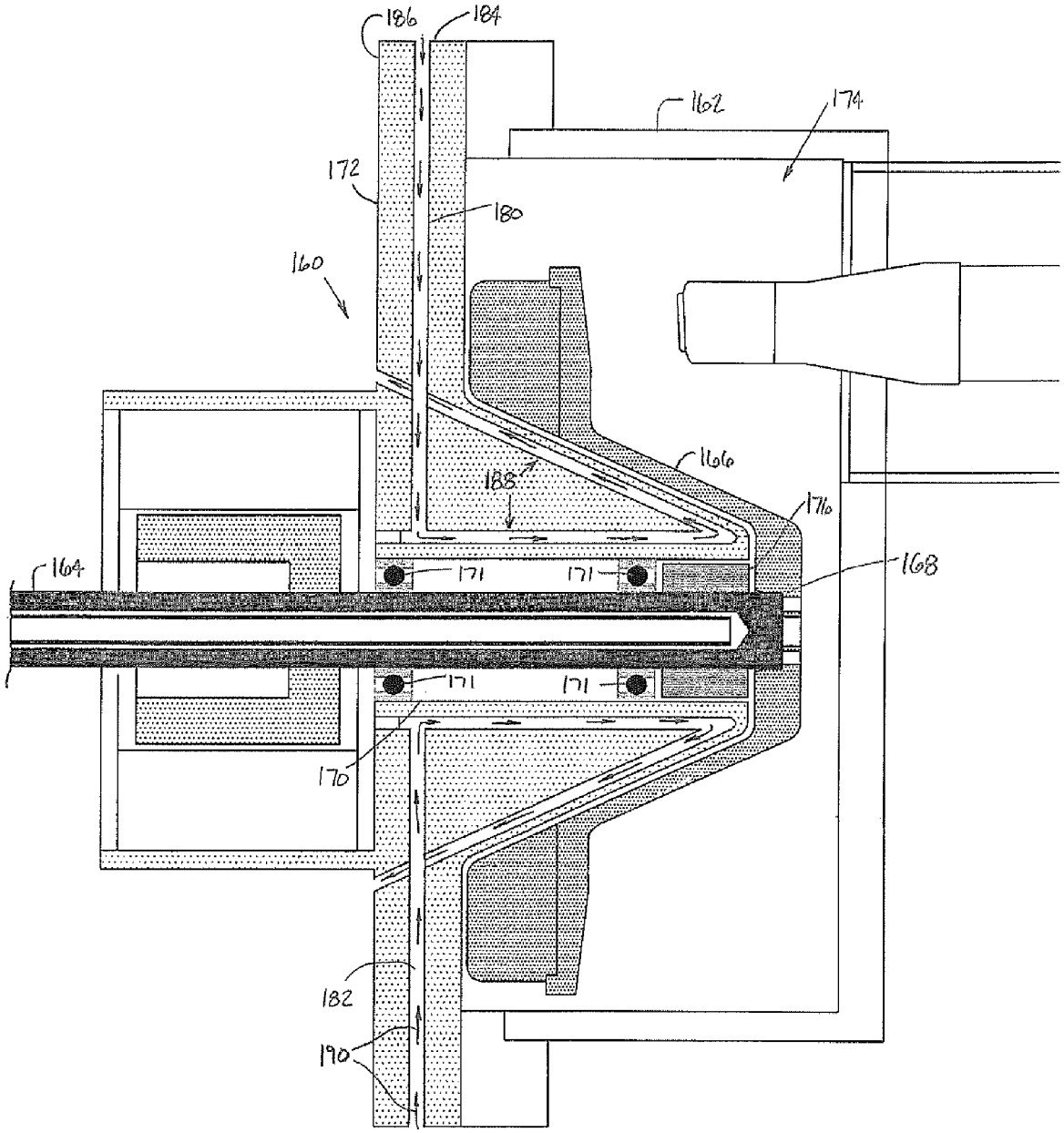
FIG. 5 is a close-up cross-sectional view of a end portion of an x-ray tube insert and corresponding rotating shaft and anode in a cantilever configuration and in accordance with another embodiment of the present invention.

Referring now to FIG. 5, a close-up cross-sectional view of a end portion 160 of an x-ray tube insert 162 and corresponding rotating shaft 164 and anode 166 are shown in a cantilever configuration and in accordance with another embodiment of the present invention. The anode 166 is coupled to an end 168 of the shaft 164. The shaft 164 rotates on a bearing set 170 having bearings 171, which resides within the sidewall structure 172 of the insert 162. The sidewall structure 172 protrudes into the vacuum chamber 174 of the insert 162. A ferrofluidic seal 176 resides between the bearing set 170 and the anode 166.

The sidewall structure 172 is inner cooled via coolant channels 180 reside therein. Cooling fluid 182 circulates through the coolant channels 180 and enters the sidewall structure on ends 184 and out the side 186 of the insert 162. The coolant channels 180 extend around a perimeter 188 of the sidewall structure 172 to provide efficient cooling thereof. Arrows 190 illustrate the circulation of the cooling fluid 182.

Figure 6:
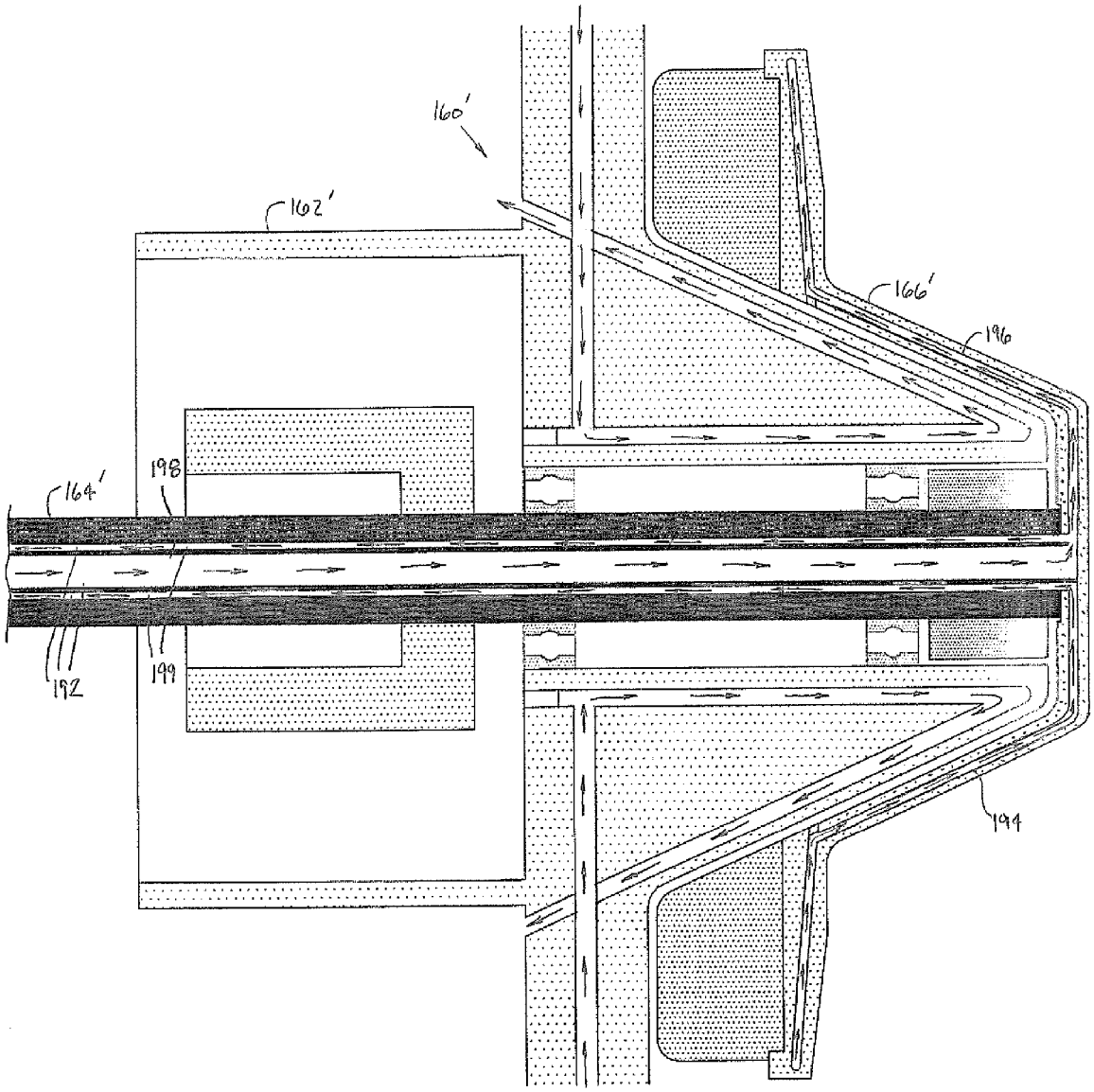
FIG. 6 is a close-up cross-sectional view of a cantilever end portion of an x-ray tube insert and corresponding rotating shaft and anode in accordance with still another embodiment of the present invention.

Referring now to FIG. 6, a close-up cross-sectional view of a cantilever end portion 160" of an x-ray tube insert 162" and corresponding rotating shaft 164" and anode 166" are shown in accordance with another embodiment of the present invention. The end portion 160" is similar to end portion 160 except that the anode 166" is also inner cooled. The shaft 164" has shaft coolant channels 192 extending therethrough that are coupled to anode coolant channels 194. The cooling fluid 196 enters coolant channel 198 circulates through coolant channels 194 and returns through coolant channels 199.

Figure 7:
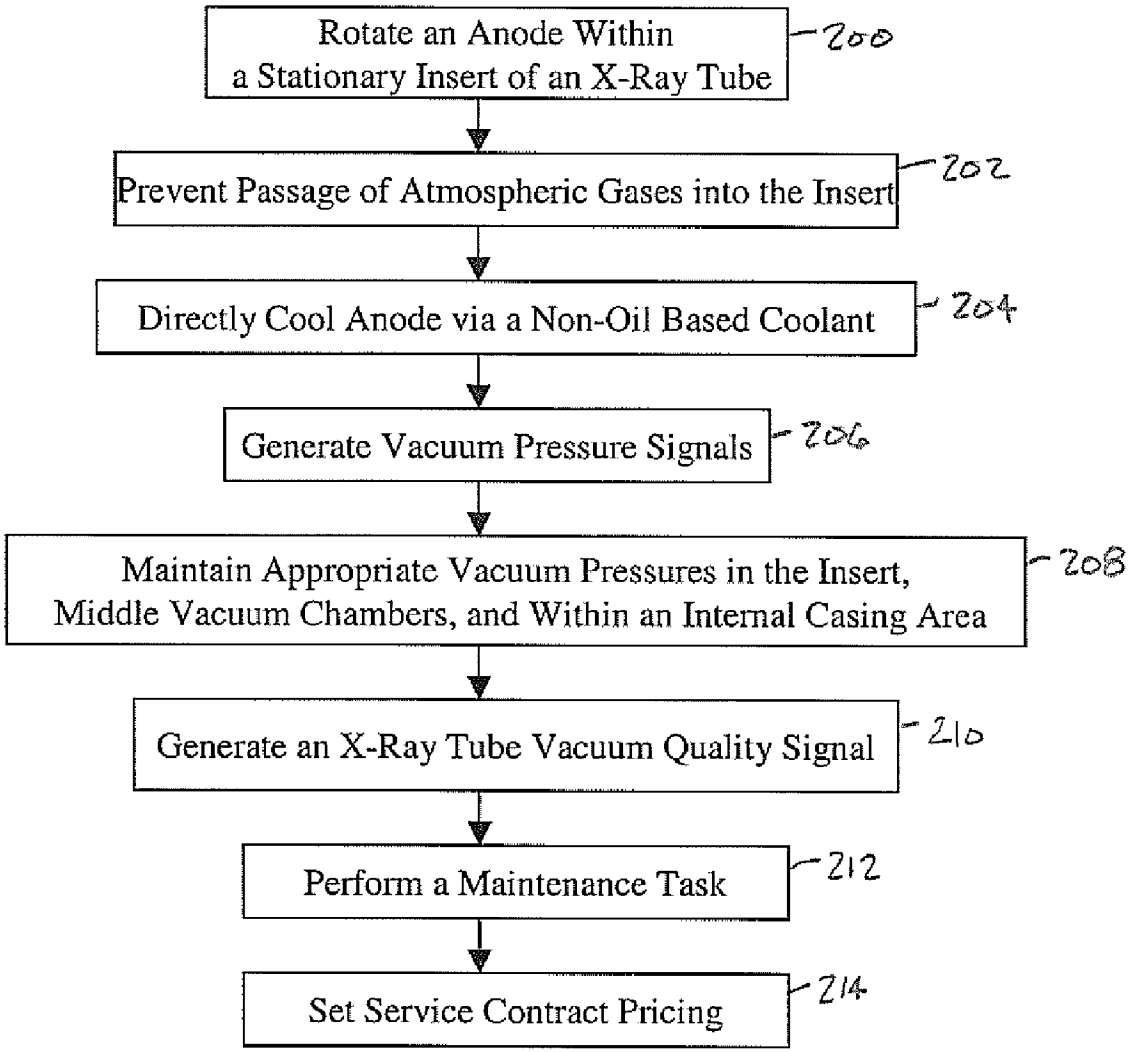
FIG. 7 is a method of operating an x-ray tube in accordance with an embodiment of the present invention.

Referring now to FIG. 7, a method of operating an x-ray tube in accordance with an embodiment of the present invention is shown. Although FIG. 5 is described with respect to the embodiments of FIG. 4, it may be easily modified to apply to other embodiments of the present invention.

In step 200, the anode 58" is rotated within the stationary insert 60" via the shaft 66" on one or more of the bearing sets 68", which are external to the insert 66".

In step 202, the rotating vacuum seals 52" and/or middle chambers 104 prevent passage of atmospheric gasses and/or vapors outside the insert 78 into the vacuum chamber 72". The other vapors can include the volatile vapors outgases from grease lubricated bearings when heated as a consequence of rotation. The middle chambers 104 provide two or more step down pressure differential transitions between the vacuum chamber 72" and the outer area 112.

In step 204, the anode 58" is directly cooled by the cooling system 54" via a non-oil based coolant, such as water, glycol, or a combination thereof.

In step 206, the vacuum sensors 106 within the insert 60", the middle chambers 104, and the internal casing area 132 generate vacuum pressure signals indicative of vacuum pressures therein.

In step 208, the controller 110 maintains the proper vacuum pressure relationships between the internal fluid 148, the middle fluids 146, and the external fluid, such as fluid in the internal casing area 132 and the outer fluid 112. The controller 110 may activate the vacuum pumps 108 to adjust the pressures within the vacuum chamber 72", the middle chambers 104, and within the internal casing area 132 in response to the vacuum pressure signals. The vacuum pumps 108 may be periodically, sporadically, or continuously activated or operated to adjust the stated pressures in response to the vacuum pressure signals. The vacuum pumps 108 may be operated at regularly scheduled intervals and when a gantry, such as gantry 12, is not rotating.

The vacuum pressure within the vacuum chamber 72" may be maintained approximately between $10^{-9}$–$10^{-5}$ Torr. The vacuum pressure with the middle chambers 104 including the internal casing area 132 may be held at a partial vacuum of between 0 and 1 times atmospheric pressure, depending upon the desired service life of the x-ray tube. The middle chambers 104 may have a lower pressure or be under a higher vacuum than that of the internal casing area 132.

In step 210, the controller 110 generates an x-ray tube vacuum quality signal in response to the vacuum pressure signals. The vacuum quality signal informs a system operator that the x-ray tube is in need of service and possible replacement. In step 212, the controller 110 or a system operator may perform a maintenance task in response to the x-ray tube vacuum quality signal. A maintenance task may include steps in preparing for the replacement of an x-ray tube, the replacement of the x-ray tube, or other steps or tasks known in the art regarding the maintenance, service, and replacement of an x-ray tube.

In step 214, service contract pricing may be set or determined in response to the x-ray tube vacuum quality signal.

The above-described steps are meant to be illustrative examples; the steps may be performed sequentially, synchronously, simultaneously, or in a different order depending upon the application.

The present invention provides x-ray tube assemblies with increased cooling efficiency and increased service life. The x-ray tube assemblies allow for increased gantry rotating speeds and the satisfaction of increased CT tube peak power requirements. The increase in gantry rotating speeds and x-ray tube peak operating power provides quicker imaging times and improved image quality.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

The invention claimed is:

1. An imaging tube assembly comprising:

a casing;

an insert contained within said casing, within a coolant bath, and having a vacuum chamber;

an anode residing within said vacuum chamber and rotating on a shaft via at least one bearing; and at least one seal residing between said insert and said shaft, said at least one seal preventing passage of said coolant bath into said vacuum chamber, being at least partially surrounded by a structural member of said insert, and residing between said anode and said at least one bearing.

2. An assembly as in claim 1 further comprising at least one pressure transition chamber coupled to said insert and said shaft, said at least one pressure transition chamber having a middle pressure between an internal fluid pressure of said vacuum chamber and an external fluid pressure of said insert.

3. An assembly as in claim 1 wherein said anode is in a cantilever configuration with said shaft relative to said insert.

4. An assembly as in claim 3 wherein said shaft comprises an end residing within said insert, said anode is coupled to and rotating via said end.

5. An assembly as in claim 3 wherein said insert comprises at least one side structure that protrudes within said vacuum chamber, said anode rotating at an inner end of said at least one side structure.

6. An assembly as in claim 3 wherein at least one side of said insert is inner cooled via a cooling fluid circulating thereabout.

7. An assembly as in claim 6 wherein said insert is inner cooled via said cooling fluid circulating therein.

8. An assembly as in claim 1 wherein said anode is inner cooled via a cooling fluid circulating therein.

9. An assembly as in claim 1 wherein said anode and said shaft are in a straddle configuration relative to said insert.

10. An assembly as in claim 1 wherein said at least one bearing comprises:

a first bearing on a first external side of said insert; and a second bearing on a second external side of said insert.

11. An assembly as in claim 1 wherein said at least one seal is a ferro-fluidic rotating vacuum seal.

12. An assembly as in claim 1 wherein said anode comprises a coolant channel for direct and internal cooling of said rotating anode.

13. An assembly as in claim 1 wherein said anode rotates relative to said insert.

14. An assembly as in claim 1 further comprising:

a cathode residing within said vacuum chamber; and a cathode-suspending member coupled to said cathode and positioning said cathode in close proximity of a target of said anode.

15. An assembly as in claim 1 further comprising a pump coupled to and removing fluid from said vacuum chamber in response to a vacuum pressure signal.

16. An imaging tube assembly comprising:

a casing;

an insert contained within said casing, within a coolant bath, and having a vacuum chamber;

an anode residing within said vacuum chamber and rotating on a shaft via at least one bearing;

said anode and said shaft being in a straddle configuration relative to said insert; and at least one pressure transition chamber coupled to said insert and said shaft, said at least one pressure transition chamber having an associated middle fluid pressure that is between an internal fluid pressure of said vacuum chamber and an external fluid pressure of said coolant bath.

17. An assembly as in claim 16 wherein said pressure transition chamber resides between said insert and said casing.

18. An assembly as in claim 17 wherein said external fluid pressure is a vacuum pressure of an outer fluid external to said casing.

19. An assembly as in claim 16 further comprising at least one seal residing between said insert and said shaft and preventing passage of at least one gas into said vacuum chamber.

20. An assembly as in claim 19 wherein a seal of said at least one seal is coupled directly to said insert, said shaft, and said pressure transition chamber.

21. An assembly as in claim 16 wherein said at least one seal comprises:

a first seal residing between said insert and said shaft; and a second seal residing between said pressure transition chamber and said shaft.

22. An assembly as in claim 16 wherein said pressure transition chamber resides in an orientation relative to said insert, said orientation selected from at least one of said pressure transition chamber residing at least partially internal to said insert and said pressure transition chamber residing at least partially external to said insert.

23. An assembly as in claim 16 wherein said middle fluid pressure is greater than said internal fluid pressure and less than said external fluid pressure.

24. An assembly as in claim 16 further comprising:

a sensor detecting pressure within said pressure transition chamber and generating a vacuum pressure signal; and a controller coupled to said sensor and adjusting pressure within said pressure transition chamber in response to said vacuum pressure signal.

25. An assembly as in claim 24 further comprising a pump coupled to said controller and removing fluid from said pressure transition chamber in response to said vacuum pressure signal.

26. An assembly as in claim 25 wherein said pump is continuously operated to maintain said middle pressure.

27. An assembly as in claim 25 wherein said pump is activated in response to said middle pressure.

28. An assembly as in claim 25 wherein said pump maintains said middle pressure approximately between 0 and 1 of atmospheric pressure.

29. An assembly as in claim 16 further comprising:

a cathode residing within said vacuum chamber; and a cathode-suspending member coupled to said cathode and positioning said cathode in close proximity of a target of said anode.

30. An assembly as in claim 16 wherein at least one side of said insert is inner cooled via a cooling fluid circulating thereabout.

31. An assembly as in claim 30 wherein said insert is inner cooled via said cooling fluid circulating therein.

32. An assembly as in claim 16 wherein said anode is inner cooled via a cooling fluid circulating therein.

33. A method of operating an x-ray tube comprising:

generating at least one pressure signal indicative of at least one vacuum pressure within at least one enclosure of the x-ray tube;

generating an x-ray tube vacuum quality signal in response to said at least one pressure signal; and determining whether to perform a maintenance task in response to said x-ray tube vacuum quality signal.

34. A method as in claim 33 further comprising preparing for replacement of the x-ray tube.

35. A method as in claim 33 further comprising setting service contract pricing in response to said x-ray tube vacuum quality signal.

36. An imaging tube assembly comprising:

a casing;

an insert contained within said casing, within a coolant bath, and having a vacuum chamber;

an anode residing within said vacuum chamber and rotating on a shaft via at least one bearing;

said anode and said shaft being in a straddle configuration relative to said insert; and at least one seal residing between said insert and said shaft, said at least one seal preventing passage of said coolant bath into said vacuum chamber.

37. The assembly of claim 36 wherein said at least one bearing comprises a first bearing on a first external side of said insert; and a second bearing on a second external side of said insert.

38. An imaging tube assembly comprising:

a casing;

an insert contained within said casing, within a coolant bath, and having a vacuum chamber;

an anode residing within said vacuum chamber and rotating on a shaft via at least one bearing;

at least one pressure transition chamber coupled to said insert and said shaft, said at least one pressure transition chamber having an associated middle fluid pressure that is between an internal fluid pressure of said vacuum chamber and an external fluid pressure of said coolant bath; and at least one seal residing between said insert and said shaft and preventing passage of at least one gas into said vacuum chamber;

a seal of said at least one seal being coupled directly to said insert, said shaft, and said pressure transition chamber.

39. An imaging tube assembly comprising:

a casing;

an insert contained within said casing, within a coolant bath, and having a vacuum chamber;

an anode residing within said vacuum chamber and rotating on a shaft via at least one bearing;

at least one pressure transition chamber coupled to said insert and said shaft, said at least one pressure transition chamber having an associated middle fluid pressure that is between an internal fluid pressure of said vacuum chamber and an external fluid pressure of said coolant bath; and at least one seal residing between said insert and said shaft and preventing passage of at least one gas into said vacuum chamber;

said at least one seal comprising: a first seal residing between said insert and said shaft; and a second seal residing between said pressure transition chamber and said shaft.

* * * * *